US009011258B2

(12) United States Patent
Yu

(10) Patent No.: US 9,011,258 B2
(45) Date of Patent: Apr. 21, 2015

(54) BALLOON FIRECRACKER DEVICE

(71) Applicant: Sam Yu, Taichung (TW)

(72) Inventor: Sam Yu, Taichung (TW)

(73) Assignee: Tailloon Balloons Co., Ltd., Taichung (TW)

( * ) Notice: Subject to any disclaimer, the term of this patent is extended or adjusted under 35 U.S.C. 154(b) by 95 days.

(21) Appl. No.: 13/964,186

(22) Filed: Aug. 12, 2013

(65) Prior Publication Data

US 2015/0045127 A1 Feb. 12, 2015

(51) Int. Cl.
*A63H 37/00* (2006.01)
*A63H 27/10* (2006.01)

(52) U.S. Cl.
CPC ..... *A63H 37/00* (2013.01); *A63H 27/10* (2013.01)

(58) Field of Classification Search
USPC ..... 472/56
See application file for complete search history.

(56) References Cited

U.S. PATENT DOCUMENTS

| | | | | | |
|---|---|---|---|---|---|
| 3,204,369 | A * | 9/1965 | Green | 446/177 |
| 3,357,128 | A * | 12/1967 | Geiser | 446/181 |
| 3,878,640 | A * | 4/1975 | Kauffman | 446/188 |
| 4,909,518 | A * | 3/1990 | Erlandson et al. | 273/357 |
| 5,947,476 | A * | 9/1999 | Rousay | 273/384 |
| 8,037,906 | B1 * | 10/2011 | Grillo | 141/10 |
| 2011/0111891 | A1 * | 5/2011 | Miramontes | 473/474 |
| 2013/0055680 | A1 * | 3/2013 | Beck et al. | 53/433 |

* cited by examiner

*Primary Examiner* — Michael Dennis
(74) *Attorney, Agent, or Firm* — Alan D. Kamrath; Kamrath IP Lawfirm, P.A.

(57) ABSTRACT

A balloon firecracker device includes a bottom plate mounted on a platform, a support post mounted on the bottom plate, a top plate slidable on the support post and provided with a spike board, a top rack mounted on the support post, a covering net mounted between the top rack and the bottom plate, a plurality of balloons received in the covering net and located between the spike board and the bottom plate, a fixing seat secured on the top plate, at least one pulley mounted on the top rack, and a pull cord extended through the pulley and connected with the fixing seat. Thus, when the top plate falls down, the spike board is moved downward to pierce and break the balloons so as to simulate the audio effect of firecrackers.

9 Claims, 6 Drawing Sheets

BALLOON FIRECRACKER DEVICE

BACKGROUND OF THE INVENTION

1. Field of the Invention

The present invention relates to a balloon device and, more particularly, to a balloon firecracker device.

2. Description of the Related Art

A conventional firecracker is used in a festival, such as the Chinese new year and the like. When the firecracker is burned, the firecracker produces a very loud sound so as to enhance excitement and amusement to the people. However, after the firecracker is used up, the firecracker produces many wastes and chips which fall down to the ground and cannot be cleaned easily and conveniently, thereby causing inconvenience to the cleaner. In addition, the firecracker produces smokes and stinky smells after being burned, thereby easily doing damage to the user's health. Further, the firecracker is easily ignited and exploded by a small fire or fuse, thereby greatly causing danger to the people.

BRIEF SUMMARY OF THE INVENTION

The primary objective of the present invention is to provide a balloon firecracker device that produces the audio effect of firecrackers.

In accordance with the present invention, there is provided a balloon firecracker device, comprising a platform, a bottom plate mounted on the platform, a support post mounted on the bottom plate and having a surface provided with a plurality of positioning holes, a top plate located above the bottom plate and having a central portion provided with a sliding tube slidably mounted on the support post, a spike board mounted on a bottom of the top plate and having a plurality of needles directed toward the bottom plate, a top rack located above the top plate and having a central portion provided with a shaft tube adjustably mounted on the support post, a fixing pin secured on the shaft tube of the top rack and positioned in one of the positioning holes of the support post to lock the top rack onto the support post, a covering net mounted between the top rack and the bottom plate, a plurality of balloons received in the covering net and located between the spike board and the bottom plate, a fixing seat secured on the top plate, at least one pulley mounted on the top rack, and a pull cord extended through the pulley and having a first end connected with the fixing seat. After the pull cord is released, the top plate falls down by its gravity, and the spike board is moved toward the bottom plate to pierce the balloons so that the balloons are pierced and broken by the spike board to produce a larger noise.

The balloon firecracker device further comprises a plurality of castors mounted on a periphery of the platform. The support post has a telescopically retractable structure with multiple sections connected with each other. The positioning holes of the support post are formed in an upper end of the support post and are spaced equally from each other. The balloon firecracker device further comprises a retaining ring mounted on a top of the support post, and a scroll-type hanging member connected with the retaining ring. The balloon firecracker device further comprises a push handle pivotally mounted on the platform. The balloon firecracker device further comprises a winding mechanism mounted on the push handle and connected with a second end of the pull cord to wind and unwind the pull cord. The winding mechanism is connected with a motor so that the winding mechanism is operated automatically. The balloon firecracker device further comprises a fixing disk mounted on a side of the winding mechanism, and a locking pin secured on the push handle and detachably locked onto the fixing disk to lock the fixing disk and the winding mechanism releasably onto the push handle.

According to the primary advantage of the present invention, after the top plate is released, the top plate falls down by its gravity, and the spike board is moved toward the bottom plate to touch the balloons so that the balloons are pierced by the spike board in an irregular manner, and are broken irregularly and successively so as to simulate the audio effect of firecrackers.

According to another advantage of the present invention, the height of the top rack can be adjusted to change the whole volume of the balloons so as to change the time interval and length of the firecrackers.

According to a further advantage of the present invention, the balloons are stored and limited in the covering net so that the balloons will not be sputtered outward from the covering net to protect the user's safety.

According to a further advantage of the present invention, the balloons will not produce a gunpowder smell or smoke when being broken to provide a comfortable sensation to the people.

According to a further advantage of the present invention, after the balloons are used up, the wastes and chips of the balloons are located and collected between the top ring and the bottom ring, so that the wastes and chips of the balloons can be cleared easily and quickly.

According to a further advantage of the present invention, the platform is provided with castors so that the balloon firecracker device can be moved easily and conveniently.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
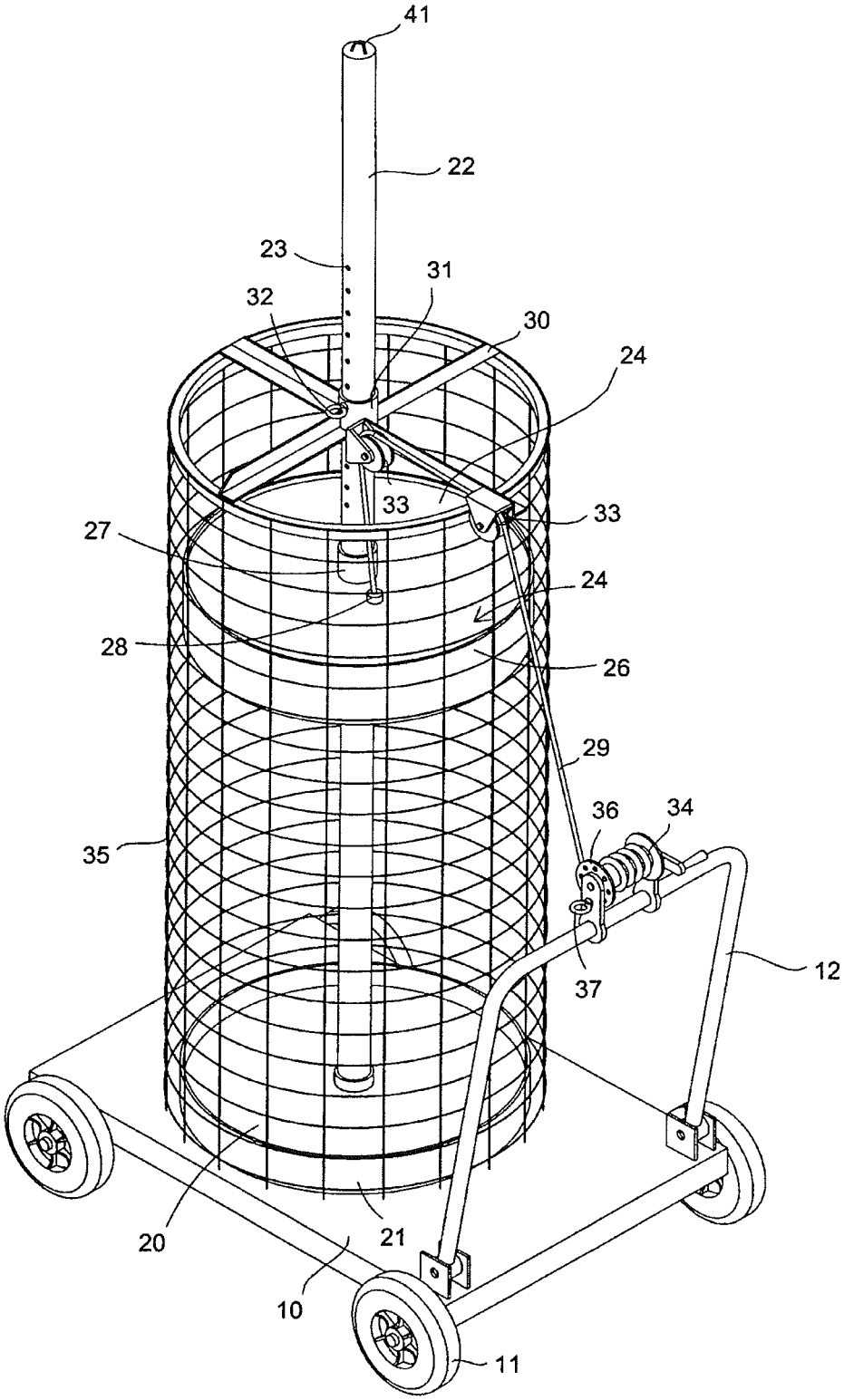
FIG. 1 is a perspective view of a balloon firecracker device in accordance with the preferred embodiment of the present invention.
Figure 2:
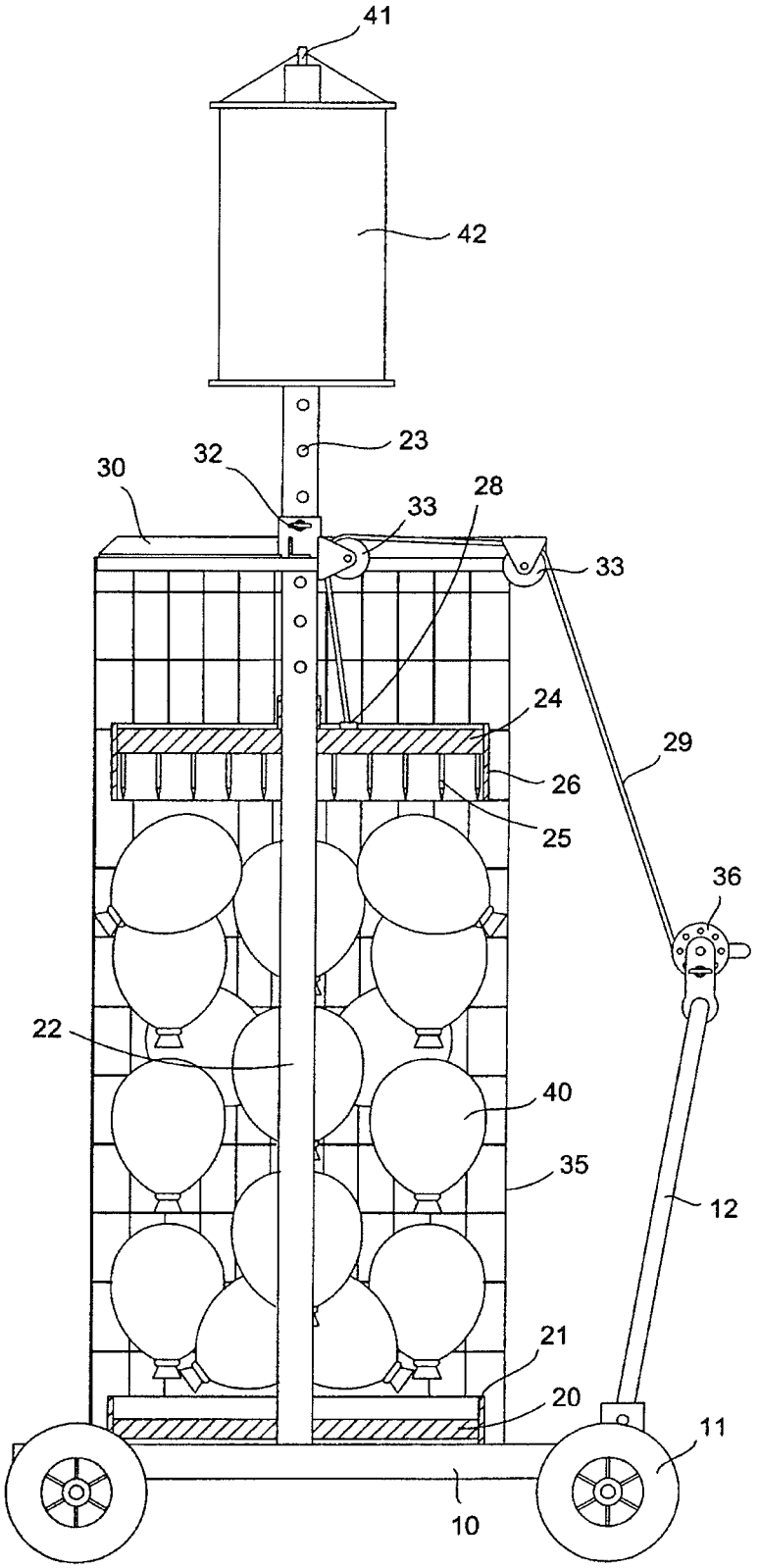
FIG. 2 is a front cross-sectional view of the balloon firecracker device as shown in FIG. 1.

Referring to the drawings and initially to FIGS. 1 and 2, a balloon firecracker device in accordance with the preferred embodiment of the present invention comprises a platform 10, a bottom plate 20 mounted on the platform 10, a support post 22 mounted on the bottom plate 20 and having a surface provided with a plurality of positioning holes 23, a top plate 24 located above the bottom plate 20 and having a central portion provided with a sliding tube 27 slidably mounted on the support post 22, a spike board 25 mounted on a bottom of the top plate 24 and having a plurality of needles directed toward the bottom plate 20, a top rack 30 located above the top plate 24 and having a central portion provided with a shaft tube 31 adjustably mounted on the support post 22, a fixing pin 32 secured on the shaft tube 31 of the top rack 30 and positioned in one of the positioning holes 23 of the support post 22 to lock the top rack 30 onto the support post 22, a covering net 35 mounted between the top rack 30 and the bottom plate 20, a plurality of balloons 40 received in the covering net 35 and located between the spike board 25 and the bottom plate 20, a fixing seat 28 secured on the top plate 24, at least one pulley 33 mounted on the top rack 30, and a pull cord 29 extended through the pulley 33 and having a first end connected with the fixing seat 28.

The bottom plate 20 is mounted on a central portion of the platform 10. A bottom ring 21 is mounted on the platform 10 and surrounds the bottom plate 20. The bottom ring 21 is encompassed by the covering net 35. The support post 22 has a lower end fixed on a central portion of the bottom plate 20. Preferably, the support post 22 has a telescopically retractable structure with multiple sections connected with each other. The positioning holes 23 of the support post 22 are formed in an upper end of the support post 22. The positioning holes 23 of the support post 22 are spaced equally from each other. The top plate 24 is movable on the support post 22 and is movable relative to the bottom plate 20. A top ring 26 is mounted on and surrounds the top plate 24. The top ring 26 is encompassed by the covering net 35 and is movable to abut the bottom ring 21. The spike board 25 is encompassed by the top ring 26. The top rack 30 includes a mounting ring and a plurality of radially arranged support bars each connected between the mounting ring and the shaft tube 31. The fixing pin 32 is adjustably positioned in one of the positioning holes 23 of the support post 22 to adjust the height of the top rack 30. The covering net 35 has an upper end connected with the mounting ring of the top rack 30 and a lower end connected with the platform 10. The fixing seat 28 is located beside the sliding tube 27 of the top plate 24.

The balloon firecracker device further comprises a plurality of castors 11 mounted on a periphery of the platform 10, a retaining ring 41 mounted on a top of the support post 22, a scroll-type hanging member 42 connected with the retaining ring 41, a push handle 12 pivotally mounted on the platform 10, a winding mechanism 34 mounted on the push handle 12 and connected with a second end of the pull cord 29 to wind and unwind the pull cord 29, a fixing disk 36 mounted on a side of the winding mechanism 34, and a locking pin 37 secured on the push handle 12 and detachably locked onto the fixing disk 36 to lock the fixing disk 36 and the winding mechanism 34 releasably onto the push handle 12. The winding mechanism 34 is connected with a motor so that the winding mechanism 34 is operated automatically.

Figure 3:
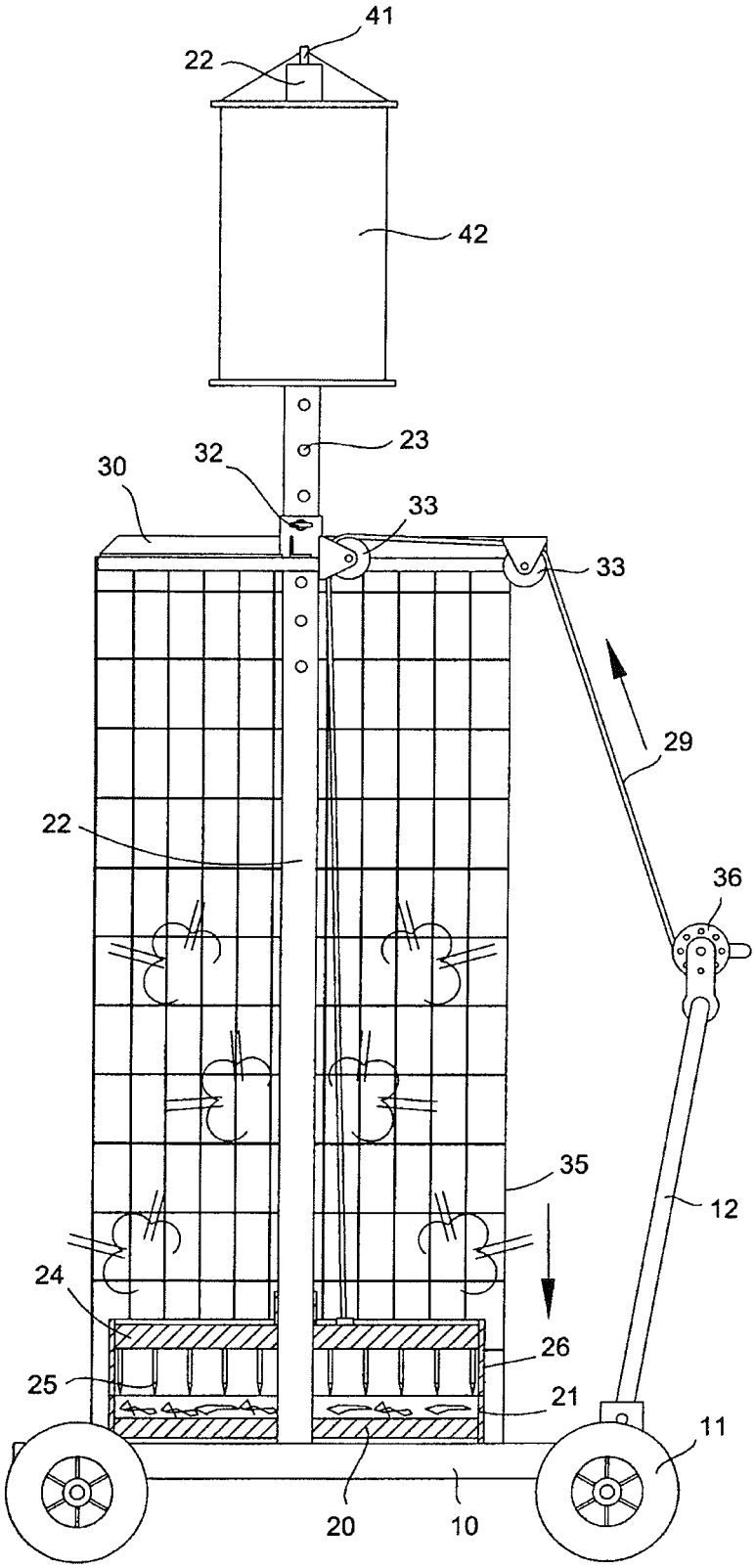
FIG. 3 is a schematic operational view of the balloon firecracker device as shown in FIG. 2 in use.

In operation, referring to FIG. 3 with reference to FIGS. 1 and 2, the balloons 40 are received in the covering net 35 and are stored in a space defined between the spike board 25 and the bottom plate 20 as shown in FIG. 2. At this time, the fixing pin 32 is adjustably positioned in one of the positioning holes 23 of the support post 22 to adjust the height of the top rack 30. In addition, the top plate 24 is positioned by the pull cord 29. Then, the winding mechanism 34 is operated to release the pull cord 29 which releases the top plate 24 so that the top plate 24 falls down by its gravity, and the spike board 25 is moved toward the bottom plate 20 to pierce the balloons 40. In such a manner, the balloons 40 are pierced and broken by the spike board 25 to produce a larger noise, such as blast, clap or bang, so as to produce a sound like that of firecrackers. In addition, the balloons 40 are pierced by the spike board 25 in an irregular manner so that the balloons 40 are broken irregularly and successively so as to simulate the audio effect of firecrackers.

Figure 4:
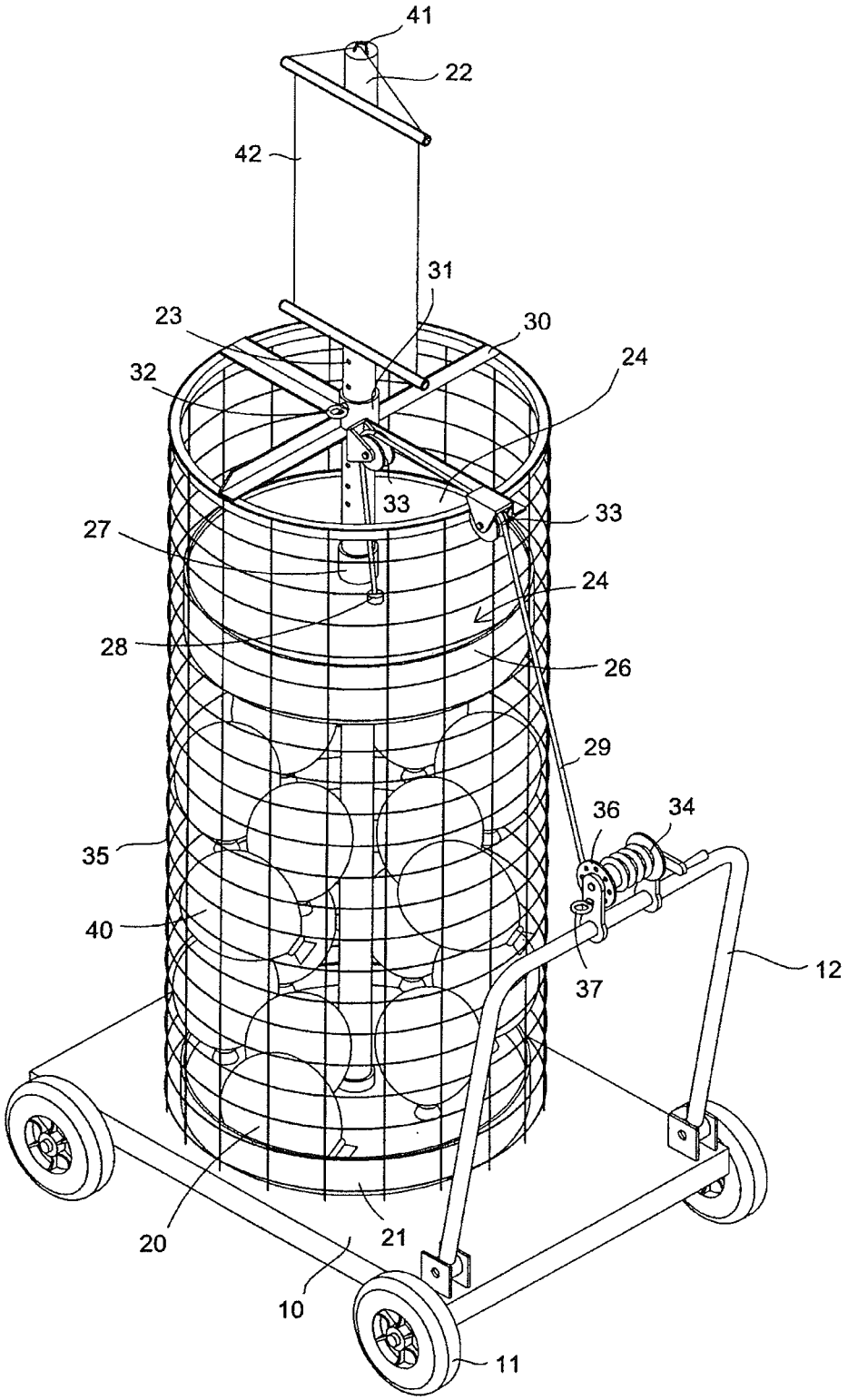
FIG. 4 is a perspective view of a balloon firecracker device in accordance with another preferred embodiment of the present invention.

As shown in FIG. 4, the hanging member 42 is provided with characters, figures or patterns, so as to enhance the outer appearance of the balloon firecracker device.

Figure 5:
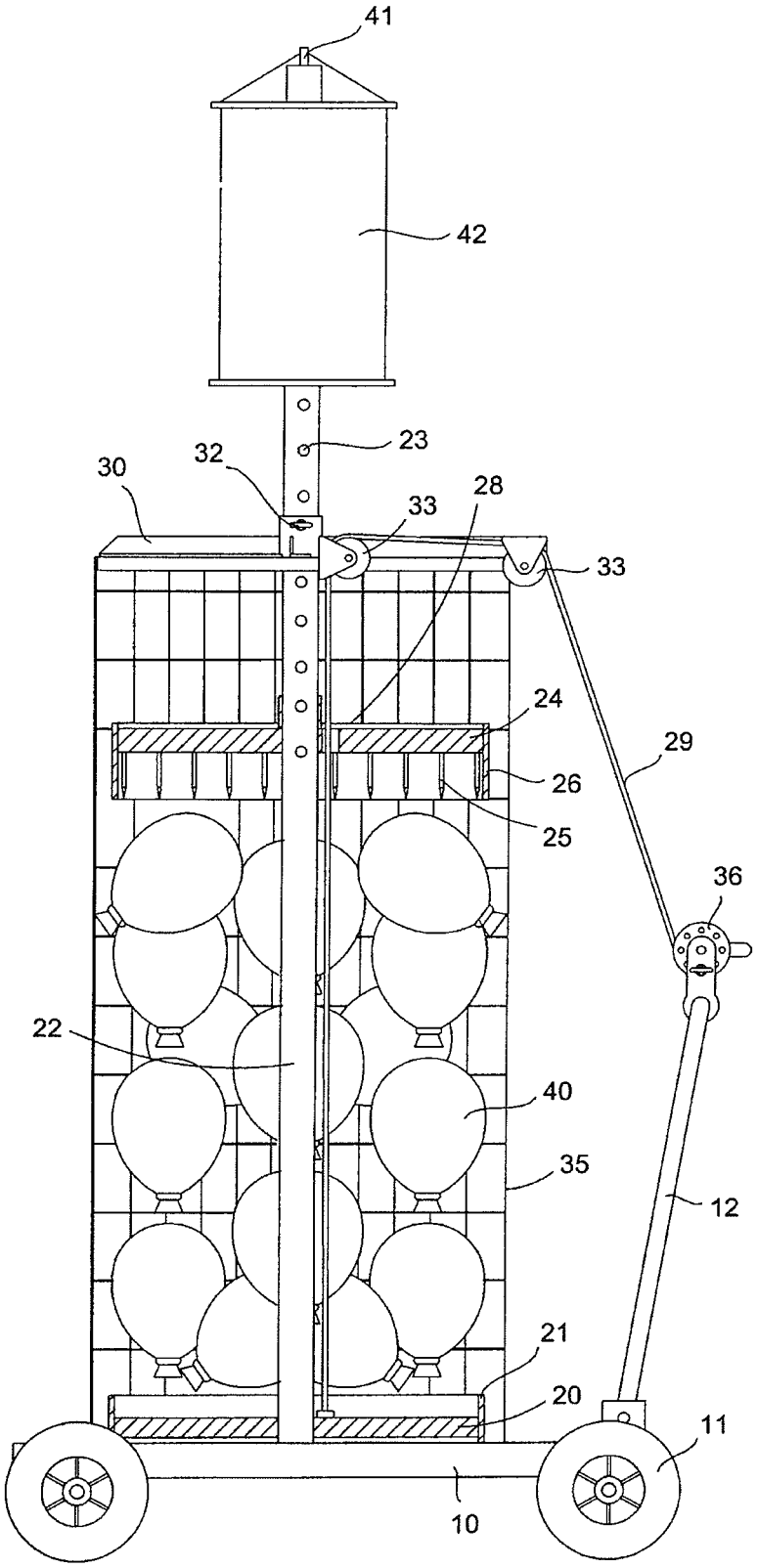
FIG. 5 is a front cross-sectional view of a balloon firecracker device in accordance with another preferred embodiment of the present invention.
Figure 6:
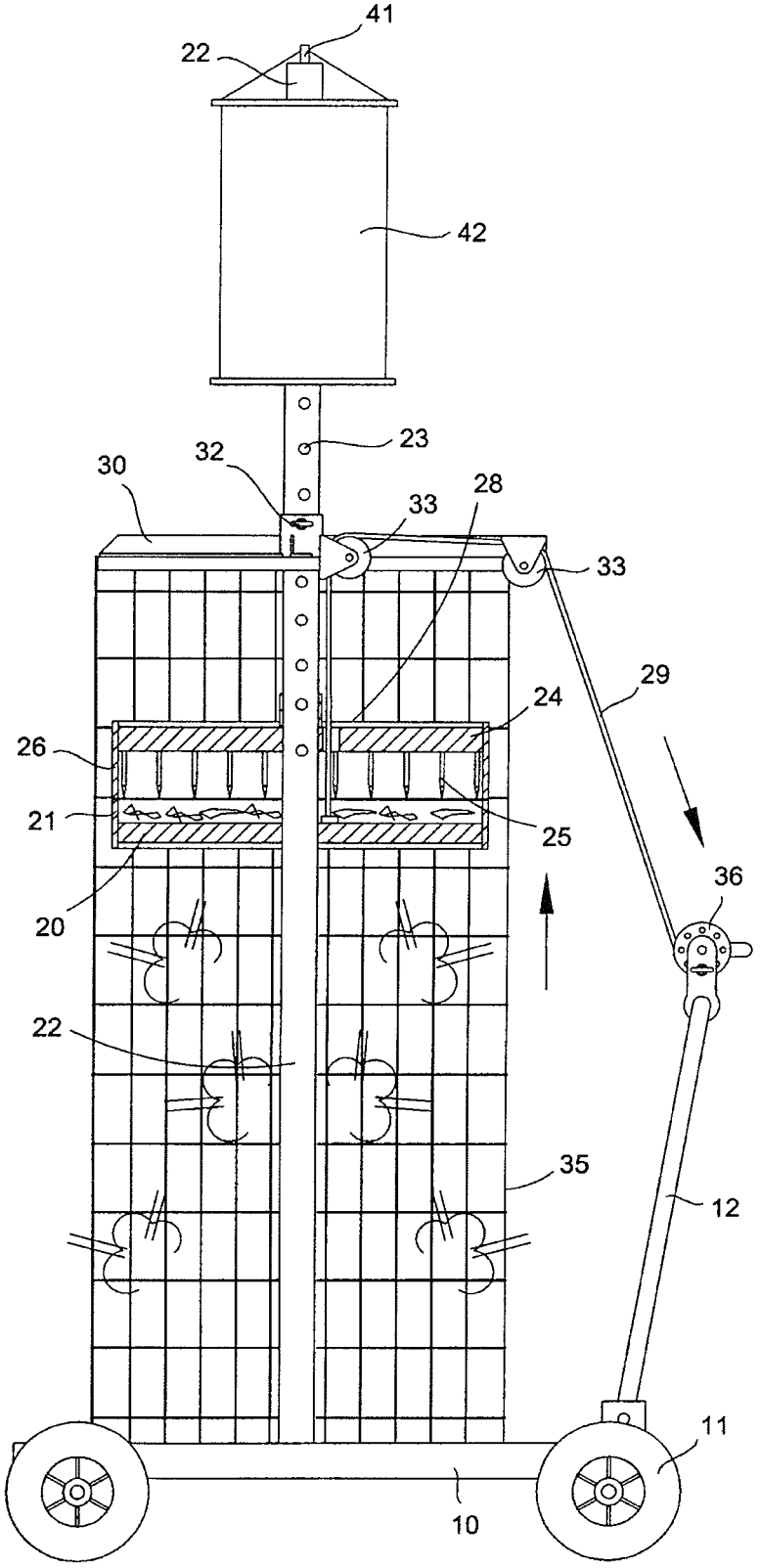
FIG. 6 is a schematic operational view of the balloon firecracker device as shown in FIG. 5 in use.

Referring to FIGS. 5 and 6, the lower end of the support post 22 is directly fixed on the platform 10, the bottom plate 20 is movable on the support post 22, and the first end of the pull cord 29 is directly connected with the bottom plate 20 to move the bottom plate 20. In operation, the winding mechanism 34 is operated to pull the pull cord 29 which moves the bottom plate 20 upward so that the bottom plate 20 is moved toward the top plate 24 and the spike board 25. In such a manner, the balloons 40 are pushed by the bottom plate 20 and are pierced and broken by the spike board 25 to produce a larger noise, such as blast, clap or bang, so as to simulate the sound and effect of firecrackers.

Accordingly, after the top plate 24 is released, the top plate 24 falls down by its gravity, and the spike board 25 is moved toward the bottom plate 20 to touch the balloons 40 so that the balloons 40 are pierced by the spike board 25 in an irregular manner, and are broken irregularly and successively so as to simulate the audio effect of firecrackers. In addition, the height of the top rack 30 can be adjusted to change the whole volume of the balloons 40 so as to change the time interval and length of the firecrackers. Further, the balloons 40 are stored and limited in the covering net 35 so that the balloons 40 will not be sputtered outward from the covering net 35 to protect the user's safety. Further, the balloons 40 will not produce a gunpowder smell or smoke when being broken to provide a comfortable sensation to the people. Further, after the balloons 40 are used up, the wastes and chips of the balloons 40 are located and collected between the top ring 26 and the bottom ring 21 as shown in FIG. 3, so that the wastes and chips of the balloons 40 can be cleared easily and quickly. Further, the platform 10 is provided with castors 11 so that the balloon firecracker device can be moved easily and conveniently.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A balloon firecracker device, comprising:

a platform;

a bottom plate mounted on the platform;

a support post mounted on the bottom plate and having a surface provided with a plurality of positioning holes;

a top plate located above the bottom plate and having a central portion provided with a sliding tube slidably mounted on the support post;

a spike board mounted on a bottom of the top plate and having a plurality of needles directed toward the bottom plate;

a top rack located above the top plate and having a central portion provided with a shaft tube adjustably mounted on the support post;

a fixing pin secured on the shaft tube of the top rack and positioned in one of the positioning holes of the support post to lock the top rack onto the support post;

a covering net mounted between the top rack and the bottom plate;

a plurality of balloons received in the covering net and located between the spike board and the bottom plate;

a fixing seat secured on the top plate;

at least one pulley mounted on the top rack; and a pull cord extended through the pulley and having a first end connected with the fixing seat;

wherein after the pull cord is released, the top plate falls down by its gravity, and the spike board is moved toward the bottom plate to pierce the balloons so that the balloons are pierced and broken by the spike board to produce a larger noise.

2. The balloon firecracker device of claim 1, wherein the balloon firecracker device further comprises a plurality of castors mounted on a periphery of the platform.

3. The balloon firecracker device of claim 1, wherein the support post has a telescopically retractable structure with multiple sections connected with each other.

4. The balloon firecracker device of claim 1, wherein the positioning holes of the support post are formed in an upper end of the support post and are spaced equally from each other.

5. The balloon firecracker device of claim 1, wherein the balloon firecracker device further comprises:

a retaining ring mounted on a top of the support post; and a scroll-type hanging member connected with the retaining ring.

6. The balloon firecracker device of claim 1, wherein the balloon firecracker device further comprises a push handle pivotally mounted on the platform.

7. The balloon firecracker device of claim 6, wherein the balloon firecracker device further comprises a winding mechanism mounted on the push handle and connected with a second end of the pull cord to wind and unwind the pull cord.

8. The balloon firecracker device of claim 7, wherein the winding mechanism is connected with a motor so that the winding mechanism is operated automatically.

9. The balloon firecracker device of claim 7, wherein the balloon firecracker device further comprises:

a fixing disk mounted on a side of the winding mechanism; and a locking pin secured on the push handle and detachably locked onto the fixing disk to lock the fixing disk and the winding mechanism releasably onto the push handle.

* * * * *